United States Patent [19]

Ishii et al.

[11] 4,367,679

[45] Jan. 11, 1983

[54] PACKING SHEET OVERLAYING DEVICE FOR OFFSET PRINTING MACHINE

[75] Inventors: Koji Ishii, Fuchu; Taro Goto, Hiroshima, both of Japan

[73] Assignee: Ryobi, Ltd., Hiroshima, Japan

[21] Appl. No.: 222,795

[22] Filed: Jan. 5, 1981

[30] Foreign Application Priority Data

Jan. 8, 1980 [JP] Japan ..... 55/841[U]

[51] Int. Cl.[3] ..... B41F 21/04

[52] U.S. Cl. ..... 101/410; 101/415.1

[58] Field of Search ..... 101/409, 410, 411, 415.1, 101/412

[56] References Cited

U.S. PATENT DOCUMENTS

| | | | |
|---|---|---|---|
| 549,282 | 11/1895 | Wendte | 101/409 |
| 1,303,793 | 5/1919 | Henderson et al. | 101/412 |
| 2,088,862 | 8/1937 | Lang | 101/409 |
| 2,406,205 | 8/1946 | Davidson et al. | 101/409 X |
| 3,296,673 | 1/1967 | Kirkpatrick | 101/415.1 X |
| 4,004,512 | 1/1977 | Jeschke | 101/410 |
| 4,263,849 | 4/1981 | Spac et al. | 101/415.1 |

*Primary Examiner*—Edgar S. Burr
*Assistant Examiner*—Charles Pearson
*Attorney, Agent, or Firm*—Sughrue, Mion, Zinn, Macpeak & Seas

[57] ABSTRACT

A packing sheet overlaying device for offset printing in which a packing sheet can readily be attached to and released from a cylinder of an offset printing machine or the like. The packing sheet is held in position at one end by a gripper which is attached to a bracket which is rotatably mounted on a cam lever shaft. A slot is formed in the bracket and a screw passes through the slot to secure the bracket to the cylinder to lock the packing sheet in place. When it is desired to change the packing sheet, the screw is loosened and the bracket rotated through an angle defined by the length of the slot to thereby form a gap between the gripper and the corresponding edge of the cylinder. The other end of the packing sheet is held in position by a tensioning mechanism including a tensioning knob provided to adjust the tension on the packing sheet.

5 Claims, 6 Drawing Figures

PACKING SHEET OVERLAYING DEVICE FOR OFFSET PRINTING MACHINE

BACKGROUND OF THE INVENTION

An example of a known offset printing machine capable of printing on both sides of a printing sheet, as shown in FIG. 1, includes an outside plate cylinder a and an outside rubber cylinder b for printing the outside of a printing sheet and an impression cylinder c serving also as an inside rubber cylinder and an inside plate cylinder d. A packing sheet (not shown in FIG. 1) is laid over the impression cylinder c. A printing sheet f is fed from a printing sheet feeding stand e to the impression cylinder c where it is clamped after which both sides of the printing sheet are printed. After being printed, the printing sheet is released and delivered to a printing sheet discharging stand g. In this manner, one printing cycle is accomplished.

The invention relates to a packing sheet overlaying device for laying a packing sheet over the impression cylinder of the above-described printing machine, the impression cylinder for a numbering machine, or the like. An object of the invention is to provide a packing sheet overlaying device with which a packing sheet can be readily and quickly laid over the cylinder of a printing machine and in which the packing sheet can be frequently replaced and printing sheets can be satisfactorily clamped.

SUMMARY OF THE INVENTION

In accordance with this and other objects of the invention, there is provided a packing sheet overlaying device for an offset printing machine including a printing machine cylinder, a cam lever shaft provided parallel to a longitudinal opening in the printing machine cylinder, a cam lever provided at one end of the cam lever shaft having a cam follower and with the cam lever turned by the cam lever and a fixed cam having cam surfaces of different levels with the cam follower being maintained in contact with the fixed cam.

There is further provided a gripper shaft having a gripper coupled thereto, brackets securing the gripper, a gripper holder, and a gripper base adapted to clamp a printing sheet between the gripper holder and the gripper base. The cam lever shaft and the gripper shaft are rotatably supported by these brackets which are arranged parallel to one another. A gear transmission mechanism couples the cam lever shaft and the gripper shaft so that the cam lever shaft and the gripper shaft are rotated relative to one another. The cylinder has an opening edge in which a locking groove is formed confronting the gripper base so that one end of a packing sheet can be detachably locked in the locking groove. A bolt is provided for tightening the brackets to and releasing the brackets from the printing machine cylinder. The bolt passes through a slot formed in one of the brackets which extends in the direction of rotation of the brackets.

DESCRIPTION OF THE PREFERRED EMBODIMENTS

A preferred embodiment of the invention will be described with reference to the accompanying drawings.

Figure 3:
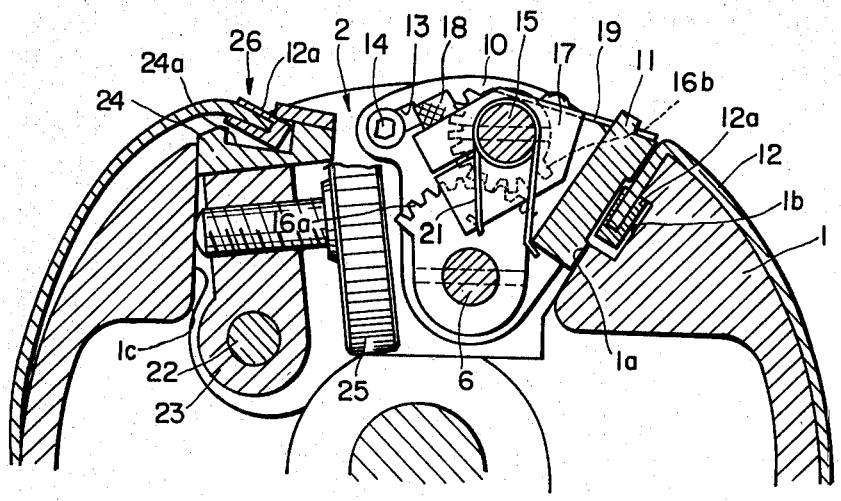
FIG. 3 is a cross-sectional view of the packing sheet overlaying device of FIG. 2 where one end of a packing sheet is secured to a cylinder.
Figure 4:
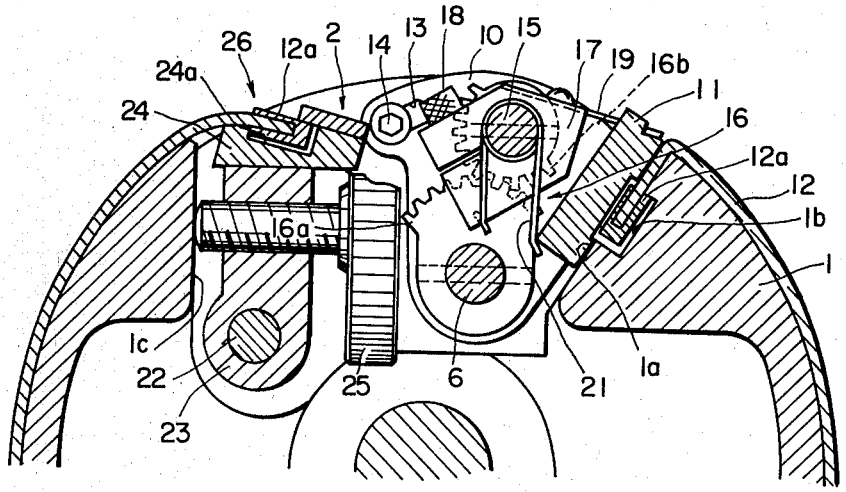
FIG. 4 is a cross-sectional view of the device of FIG. 2 where both ends of the packing sheet are secured to the cylinder.
Figure 5:
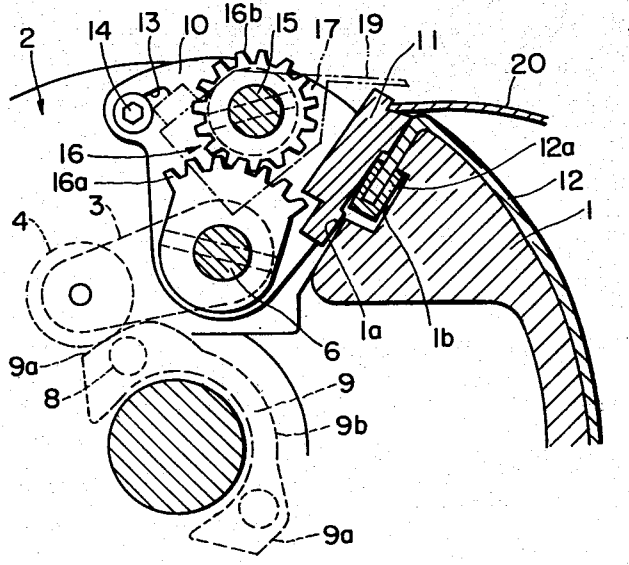
FIG. 5 is also a cross-sectional view of the device of FIG. 2 in which the gripper is opened.
Figure 6:
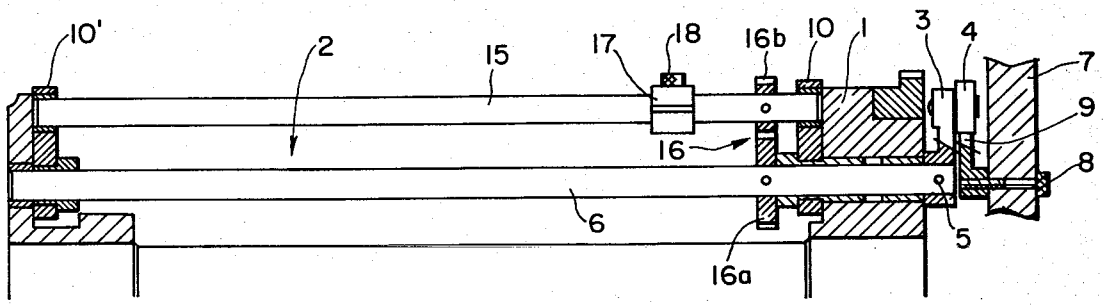
FIG. 6 is a longitudinal sectional view of the packing sheet overlaying device of FIG. 2.

Referring to FIGS. 2 through 6, a cam lever shaft 6 to one end of which a cam follower 4 is secured with a pin 5 is rotatably supported by a cylinder 1 of a printing machine along an opening 2 which is formed in the axial direction of the cylinder 1. A cam 9 (FIGS. 5 and 6) is secured to a frame 7 with screws 8. When the cam follower 4 rides onto a higher portion 9*a* of the cam 9 as shown in FIG. 5, the cam lever shaft 6 is turned clockwise as viewed in FIG. 5. The cam lever shaft 6 rotatably supports first ends of brackets 10 and 10'. A gripper base 11 is fixedly secured to the brackets 10 and 10' in such a manner that it confronts an opening edge 1*a* of the cylinder 1. The gripper base 11 is so designed that a first end portion of a packing sheet 12 can be interposed between the gripper base 11 and the opening edge 1*a* by turning the brackets 10 and 10' clockwise while a gap l is formed between the gripper base 11 and the opening edge 1*a* by turning the brackets 10 and 10' counterclockwise to release the packing sheet 12. The brackets 10 and 10' have a slot 13 which extends a predetermined distance in the direction of rotation of the brackets. A bolt 14 is inserted into the slot 13 with which the brackets 10 and 10' can be tightened to or loosened from the cylinder 1 as desired. That is, when the bolt 14 is loosened, the brackets 10 and 10' can turn within a range defined by the length of the slot 13.

A gripper shaft 15 is rotatably supported by the other ends of the brackets 10 and 10' parallel to the cam lever shaft 6. The shafts 6 and 15 are coupled to each other through a gear-transmission mechanism 16.

The gear-transmission mechanism 16 is composed of gears 16*a* and 16*b* which are engaged with each other and are fixedly secured to the cam lever shaft 6 and the gripper shaft 15, respectively. Accordingly, the gripper shaft 15 is rotated by rotation of the cam lever shaft 6. A gripper 19 is mounted on the gripper shaft 15 by securing a gripper holder 17 thereto with a screw 18. More specifically, the gripper 19 is so designed that a printing sheet 20 can be interposed or caught between the gripper 19 and the gripper base 11. A torsion spring 21 is wound around the gripper shaft 15 and one end of the spring 21 is engaged with the gripper holder 17 while the other end is engaged with the gripper base 11 so that the gripper 19 is urged to turn clockwise to clamp the printing sheet.

A locking groove 1*b* is formed in the opening edge 1*a* of the cylinder 1 confronting the gripper base 11. The locking groove 1*b* is adapted to secure the retainer 12*a* which is attached to one end of the packing sheet 12.

A bracket 23 is provided in the opening 2 of the cylinder, as shown in FIGS. 3 and 4. The bracket 23 turns around a shaft 22 which is supported by the cylinder 1.

A holder 24 having a locking groove 24a is fixedly secured to the bracket 23 and the threaded shaft of a tensioning knob 25 is screwed in the bracket 23 to provide a packing sheet tensioning mechanism 26 which is adapted to detachably secure the second end of the packing sheet 12 and to tension the packing sheet 12 or release the tension thereof.

Figure 1:
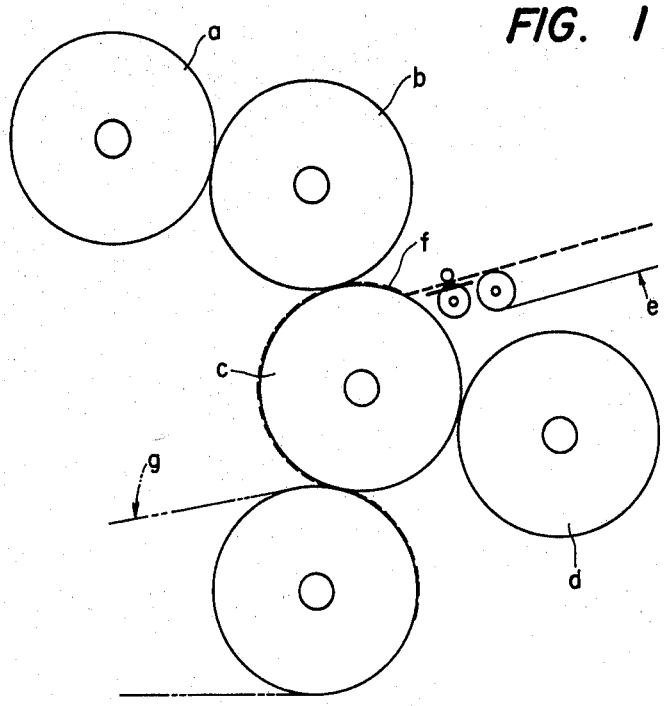
FIG. 1 is a side view showing an example of a known type of an offset printing machine.
Figure 2:
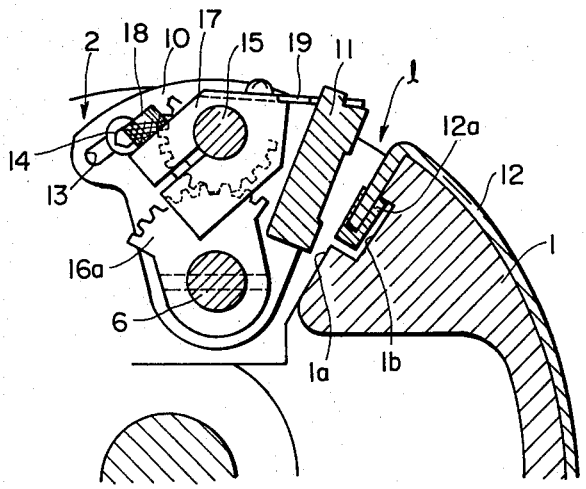
FIG. 2 is a cross-sectional view of a packing sheet overlaying device according to the invention.

In laying the packing sheet 12 over the cylinder, first the tensioning knob 25 of the tensioning mechanism 26 is loosened and then the bolt 14 is also loosened. Under this condition, as the brackets 10 and 10' are turned counterclockwise, as viewed in the figures, around the cam lever shaft 6 within the range defined by the length of the slot 13, the gripper base 11 is also turned counterclockwise to cause it to open as a result of which the gap l is provided between the gripper base 11 and the opening edge 1a of the cylinder 1 as shown in FIG. 2. Under this condition, the first end of the packing sheet 12 is inserted into the gap l and then the retainer 12a is locked in the locking groove 1b.

Thereafter, the brackets 10 and 10' are turned clockwise to close the opening edge 1a with the gripper base 11 so that the first end of the packing sheet 12 is sandwiched between the opening edge 1a and the gripper base 11. Under this condition, the bolt 14 is tightened to fixedly secure the brackets 10 and 10' to the cylinder 1. Thus, the first end of the packing sheet is fixedly fastened to the cylinder 1 as shown in FIG. 3.

After the first end of the packing sheet 12 has been secured to the cylinder 1 as described above, the packing sheet 12 is wound around the cylinder 1, and the retainer 12a which is connected to the second end of the packing sheet 12 is engaged with the locking groove 24a of the holder 24. Under this condition, the tensioning knob 25 is screwed in. As a result, the end of the threaded shaft of knob 25 is abutted against the other opening edge 1c of the opening 2 to thereby turn the bracket 23 clockwise around the shaft 22. Thus, the state of the packing sheet 12 shown in FIG. 3 is changed to that shown in FIG. 4, that is, the packing sheet 12 is tensioned.

As the cam follower 4 rides on the higher portion 9a of the cam 9 upon rotation of the cylinder 1, a cam lever 3 is turned clockwise around the cam lever shaft 6 in FIG. 5 and the cam lever shaft 6 is also turned. Due to the engagement of the gear 16a with the gear 16b, the gripper shaft 15 is turned counterclockwise in FIG. 5 to open the gripper 19 as indicated by the two-dot chain line in FIG. 5. As the cam follower 4 comes to the lower portion 9b of the cam 9, the gripper 19 is turned clockwise to close as a result of which the printing sheet 20 is clamped between the gripper 19 and the gripper base 11 and is held there with the aid of the torsion spring 21.

Accordingly, with the higher and lower portions 9a and 9b of the cam 9 being so positioned that the gripper 19 is opened and closed in synchronization with the supply and ejection of printing sheets 20, each printing sheet 20 is clamped before being printed and released after being printed whereupon it is automatically discharged to a sheet discharge stand.

As is apparent from the above description, in the packing sheet overlaying device of the invention, the brackets 10 and 10' are turned around the cam lever shaft 6 to open and close the gripper base 11 which is adapted to clamp a packing sheet 12. After the packing sheet 12 is clamped, the brackets 10, 10' are secured by the bolt 14. The gripper 19 is caused to open and close due to the actuating motion of the cam 9 supported by the frame 7. One end of a packing sheet 12 is detachably secured between the gripper base 11 provided on the brackets 10 and 10' and the cylinder opening edge 1a. With this structure, an old packing sheet 12 can be replaced with a new one merely by releasing the brackets 10 and 10' from the cylinder 1 and then tightening them to the cylinder 1 with the bolt 14. Thus, the packing sheet 12 can be attached to the cylinder or removed from the cylinder readily in a short time without the need for conducting troublesome operations such as engagement or disengagement of the gripper holder, gripper, gripper base and gripper shaft. After a packing sheet 12 has been laid over the cylinder, the printing sheet clamping mechanism and its relevant components are readily reset to their original positions without the need of complex operations.

The retainer 12a at the first end of the packing sheet 12 is clasped firmly in the locking groove 1b formed in the opening edge 1a of the cylinder 1 and is then held by the gripper base 11. Accordingly, the packing sheet 12 can be readily laid over or removed from the cylinder as described above and yet the packing sheet 12 is positively maintained on the cylinder. Furthermore, according to the invention, the mechanism for clamping a printing sheet 20 is provided along with the packing sheet overlaying device. Therefore, the packing sheet overlaying device of the invention is applicable to an impression cylinder which is also employed as a rubber cylinder in a printing machine capable of printing on both sides of a printing sheet or to an impression cylinder in a numbering mechanism.

What is claimed is:

1. A packing sheet overlaying device for an offset printing machine comprising:

a printing machine cylinder;

a cam lever shaft provided parallel to a longitudinal opening in said printing machine cylinder;

a cam lever provided at one end of said cam lever shaft, said cam lever shaft being turned by said cam lever, said cam lever having a cam follower;

a fixed cam having cam surfaces of different levels, said cam follower being maintained in contact with said fixed cam;

a gripper shaft provided with a gripper, brackets securing said gripper, a gripper holder, and a gripper base adapted to clamp a printing sheet between said gripper and said gripper base, said cam lever shaft and said gripper shaft being rotatably supported by said brackets and being arranged parallel to each other;

a gear-transmission mechanism for coupling said cam lever shaft and said gripper shaft so that said cam lever shaft and said gripper shaft are rotated relative to each other;

said cylinder having an opening edge in which a locking groove is formed confronting said gripper base so that one end of a packing sheet is detachably lockable in said locking groove; and a bolt for tightening said brackets to and releasing said brackets from said cylinder, said bolt passing through a slot formed in one of said brackets extending in the direction of rotation of said brackets, said brackets when released being movable between a clamping and a non-clamping position within a range defined by said slot, said gripper base being in close proximity of said packing sheet when said brackets are in said clamping position and said gripper base being displaced from said packing sheet when said brackets are in said non-clamping position.

2. The packing sheet overlaying device of claim 1 further comprising a torsion spring wound around said gripper shaft and with one end thereof engaged with said gripper holder and the other end thereof engaged with said gripper base to urge said gripper in a direction so as to clamp a printing sheet.

3. The packing sheet overlaying device of claim 1 wherein said locking groove is adapted to secure a retainer attached to said end of said packing sheet.

4. The packing sheet overlaying device of any of claims 1–3 further comprising a packing sheet tensioning mechanism for detachably securing and tensioning a second end of said packing sheet.

5. The packing sheet overlaying device of any of claims 1–3 further comprising a packing sheet tensioning mechanism for detachably securing and tensioning a second end of said packing sheet, said tensioning mechanism comprising a packing sheet tensioning mechanism shaft, a tensioning bracket rotatably mounted on said packing sheet tensioning mechanism shaft; a holder having a locking groove formed therein at an outer end of said tensioning bracket; and a tensioning knob having a threaded shaft threadably engaged with said tensioning bracket and having an end abutting an opening edge of said opening in said printing machine cylinder.

* * * * *